US005573607A

United States Patent [19]

Weaver

[11] Patent Number: 5,573,607

[45] Date of Patent: Nov. 12, 1996

[54] METAL MATRIX COMPOSITES OF ALUMINUM, MAGNESIUM AND TITANIUM USING SILICON BORIDES

[75] Inventor: Samuel C. Weaver, Knoxville, Tenn.

[73] Assignee: Millennium Materials, Inc., Knoxville, Tenn.

[21] Appl. No.: 467,188

[22] Filed: May 6, 1995

[51] Int. Cl.[6] ..... C22C 21/00

[52] U.S. Cl. ..... 148/437; 148/420; 148/421; 420/402; 420/417; 420/528; 428/546

[58] Field of Search ..... 148/420, 421, 148/437; 420/402, 417, 528; 428/546

[56] References Cited

U.S. PATENT DOCUMENTS 5,196,059 3/1993 Niebylski ..... 106/287.11

*Primary Examiner*—David A. Simmons
*Assistant Examiner*—Robert R. Koehler
*Attorney, Agent, or Firm*—Pitts & Brittian, P.C.

[57] ABSTRACT

A metal matrix composite of aluminum, magnesium or titanium, and their alloys, containing particles of a silicon boride composition. A preferred form of the boride is silicon hexaboride. A small amount of carbon can be present in the silicon boride composition as Si—B—C. The particles can be pre-blended with particles of the metal prior to melting, or can be added after the melting of the metal. Because of the similar specific gravity of silicon boron compounds and aluminum, very little stirring is required to achieve a homogeneous mixture in the melt. This substantially reduces formation of oxide and hydrogen inclusions. Improved machinability is achieved through utilization of rounded particles. The composite has improved strength, stiffness and reduced thermal coefficient of expansion, thus making the composite composition more useful in industry.

20 Claims, No Drawings

METAL MATRIX COMPOSITES OF ALUMINUM, MAGNESIUM AND TITANIUM USING SILICON BORIDES

TECHNICAL FIELD

The present invention relates generally to the strengthening of metal bodies by using metal matrix composites, and more particularly to the strengthening of aluminum, magnesium and titanium by forming metal matrix composites of these metals using silicon borides and variations of silicon borides of the form Si-C-B. In particular, the metal matrix composites utilize silicon hexaboride.

BACKGROUND ART

The light weight metals of aluminum and magnesium have very large markets for they are utilized in a wide variety of industries. In a lesser way, titanium is also utilized as a light weight fabrication material. These metals suffer from some drawbacks, however, which limit their usefulness. These include low stiffness (low modulus of elasticity), high thermal coefficient of expansion, and low strength. Some of these drawbacks have been overcome through the use of metal matrix composites of these metals. Typically, ceramics are added to the metals. The primary objectives of these additives have been to increase the modulus of elasticity and to reduce the thermal coefficient of expansion. When fibrous material, such as silicon carbide whiskers, are added, strengthening has been observed. Other added materials include the fibers of boron metal, carbon, aluminum silicate, and aluminum oxide. Still other typical strengthening agents are aluminum oxide particulates, boron carbide and silicon carbide in various forms.

Of these, only aluminum oxide particulate and silicon carbide particulate have been extensively utilized in the aluminum-based matrix. To add either of these to molten aluminum, a continuous stirring action must be utilized because the specific gravities of the additives are significantly greater than the molten aluminum. Similar problems would be observed with molten magnesium. The continuous stirring causes oxide inclusions and hydrogen to contaminate the melts. Furthermore, because of the contamination and the non-uniform nature of the metal matrix composites (MMC'S), remelting (for recycle, etc.) is a problem due to the variability of the resulting feed product.

Accordingly, it is an object of the present invention to provide a metal matrix composite using aluminum, magnesium and titanium wherein a minimum of stirring is required to maintain the additive material in suspension.

It is another object of the present invention to provide a metal matrix composite wherein the strengthening agent has a specific gravity very like that of the molten metal whereby there is little settling of the strengthening agent during the formation of the metal matrix composite.

A further object of the present invention is to provide a metal matrix composite of aluminum, magnesium or titanium that can be more easily machined.

Also, it is an object of the present invention to provide a metal matrix composite of aluminum or magnesium that can be easily remelted to better utilize unused portions.

These and other objects of the present invention will become apparent upon a consideration of the following detailed description.

SUMMARY OF THE INVENTION

In accordance with the present invention, silicon hexaboride and closely related compounds are added to molten aluminum, magnesium and titanium to form improved metal matrix composites. Since the silicon hexaboride and similar silicon borides have a specific gravity approximating that of molten aluminum, little settling occurs and thus a minimum of stirring is required to maintain a uniform distribution. Thus, a minimum of contamination occurs and the composition is very homogeneous throughout the composite. This facilitates the ease of a remelting cycle if desired. The composite can be made particularly machineable when the additive is generally spheroidal in shape. The compositions have desired modulus of elasticity, coefficient of expansion and strength. While of particular use with the pure metals, the present invention is also applicable to alloys of aluminum, magnesium and titanium.

BEST MODE FOR CARRYING OUT THE INVENTION

A metal matrix composite was fabricated by adding particles of silicon hexaboride to molten aluminum. The silicon hexaboride was prepared by a substantially commercial process and was comparable with that supplied by CERAC of Chicago, Ill. Since the specific gravity of the hexaboride is very close to that of aluminum, only a minimal amount of stirring was required to achieve a homogeneous mixture. If heating is accomplished in an induction furnace, a stirring action is automatically achieved. Some mechanical stirring is required under other conditions of heating.

While a range of compositions of from about 0.1 wt. % to about 80 wt. % of $SiB_6$ can be utilized relative to the aluminum, a range of about 10 to about 40 wt. % is most practical for most applications and was utilized for testing. The silicon hexaboride typically had an average particle size of about 20 micrometers, although a range of about 0.1 to about 200 micrometers can be used. In a preferred form of the invention, the silicon hexaboride is generally rounded (e.g., spheroidal). As such, improved machining properties of the resultant metal matrix composite are achieved.

The addition of the silicon hexaboride to the molten metal was principally utilized in the development of the present invention. However, it will be understood that the invention also includes the blending of the $SiB_6$ particulate with powdered aluminum metal and any other alloying constituents prior to melting the mixture. The molten mixture can be cast into a desired shape either as a finished product or a body for further processing.

Magnesium and titanium have low specific gravities similar to that of aluminum. Accordingly, metal matrix composites of these metals with silicon hexaboride and similar silicon borides is within the scope of the present invention.

Certain other silicon-boride compositions have specific gravity values close to that of silicon hexaboride. For example, silicon tetraboride ($SiB_4$) is expected to perform in a manner similar to that of the hexaboride. Similarly, these compounds with a small amount of carbon (typically less than 25 wt. %) are within the scope of the invention. Excluded from such Si—B—C strengthening agents are $B_4C$ and SiC.

From the foregoing, it will be understood that improved metal matrix composites of aluminum, magnesium and titanium are achieved by the addition of a silicon boride material. Specifically, silicon tetraboride and silicon hexaboride are of value, with the $SiB_6$ being of greatest value. The composition can be easily prepared with a minimum of stirring, and the product can be recycled if desired. When the additive is in the form of rounded particles, the composite is more easily machined for the forming of specific shapes.

Although specific compositions and particulate sizes are discussed above, these are for the purpose of illustration and not for limiting the present invention. Rather, the invention is to be limited only by the appended claims and their equivalents.

I claim:

1. A metal matrix composite formed from a molten metal selected from the group consisting of aluminums magnesium, titanium and mixtures thereof, and particles of a silicon boride composition selected from the group consisting of silicon tetraboride and silicon hexaboride, said silicon boride composition being present in a range of about 0.1 to about 80 wt. % in the metal.

2. The composite of claim 1 wherein said silicon boride composition is silicon hexaboride.

3. The composite of claim 2 wherein said silicon hexaboride has an average particle size of about 0.1 to about 200 micrometers.

4. The composite of claim 3 wherein said silicon hexaboride has an average particle size of about 20 micrometers.

5. The composite of claim 1 wherein the metal is aluminum.

6. The composite of claim 4 wherein said metal is aluminum.

7. The composite of claim 1 wherein said silicon boride composition is in the form of spheroidal particles.

8. The composite of claim 1 further having carbon in said silicon boride composition in addition to said metal.

9. A metal matrix composite formed from molten aluminum metal and particles of a silicon boride composition selected from the group consisting of silicon tetraboride and silicon hexaboride, the silicon boride composition being present in a range of about 0.1 to about 80 wt. % in the metal.

10. The composite of claim 9 wherein said silicon boride composition is silicon hexaboride.

11. The composite of claim 10 wherein said silicon hexaboride has an average particle size of about 0.1 to about 200 micrometers.

12. The composite of claim 10 wherein said silicon hexaboride has an average particle size of about 20 micrometers.

13. The composite of claim 10 wherein said silicon boride composition is in the form of spheroidal particles.

14. The composite of claim 10 further having carbon in said silicon boride composition in addition to said metal.

15. The composite of claim 14 wherein said carbon is present from about 0.1 up to about 25 wt. % in said silicon boride composition.

16. A metal matrix composite formed from molten aluminum metal and silicon hexaboride particles, said silicon hexaboride having an average particle size of 20 micrometers and being present in a range of about 0 1 to about 80 wt in the metal.

17. The composite of claim 16 wherein said silicon hexaboride particles are spheroidal in shape.

18. The composite of claim 16 wherein said silicon hexaboride particles contain about 0.1 to about 25 wt. % carbon.

19. The composite of claim 16 wherein said silicon hexaboride particles were present in a range of about 10 to about 40 wt. %.

20. The composite of claim 9 wherein said silicon boride composition was present in a range of about 10 to about 40 wt. %.

* * * * *